United States Patent [19]

Lohr

[11] 4,066,271

[45] Jan. 3, 1978

[54] TOY VEHICLE

[76] Inventor: Raymond J. Lohr, 5043 Sterrettania Road, Erie, Pa. 16506

[21] Appl. No.: 742,087

[22] Filed: Nov. 16, 1976

Related U.S. Application Data

[63] Continuation-in-part of Ser. No. 635,583, Nov. 28, 1975, Pat. No. 3,999,771.

[51] Int. Cl.[2] ..... A63G 19/08

[52] U.S. Cl. ..... 280/1.182; 280/218

[58] Field of Search ..... 280/1.181, 1.182, 1.183, 280/1.184, 218, 1.13 R

[56] References Cited

U.S. PATENT DOCUMENTS 1,773,062 8/1930 Rothschild ..... 280/1.183

2,066,043 12/1936 Laborda ..... 280/218

*Primary Examiner*—Philip Goodman
*Assistant Examiner*—John A. Pekar
*Attorney, Agent, or Firm*—Charles L. Lovercheck

[57] ABSTRACT

A toy having a body and a downwardly-extending rear frame movably supported on the body with a spring on the frame to urge the body upwardly, an axle supported on the lower end of the frame and wheels attached to the axle. The axle has a one-way clutch attached to it and the clutch is connected to the body by a cord. As the body moves downwardly, stressing the spring, the clutch is free-wheeled in a first direction and, when the spring forces the body upward, the cord rotates the clutch rotating the axle and, with it the wheels.

9 Claims, 3 Drawing Figures

TOY VEHICLE

REFERENCE TO CO-PENDING APPLICATION

This application is a continuation-in-part of patent application Ser. No. 635,583, filed Nov. 28, 1975, now issued as U.S. Pat. No. 3,999,771.

OBJECTS OF THE INVENTION

It is an object of the invention to provide an improved toy wherein a child sitting on the toy can bounce it up and down, and thereby rotate the wheels in a forward direction.

Another object of the invention is to provide an improved toy.

Another object of the invention is to provide a toy that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

DETAILED DESCRIPTION OF DRAWINGS

Figure 1:
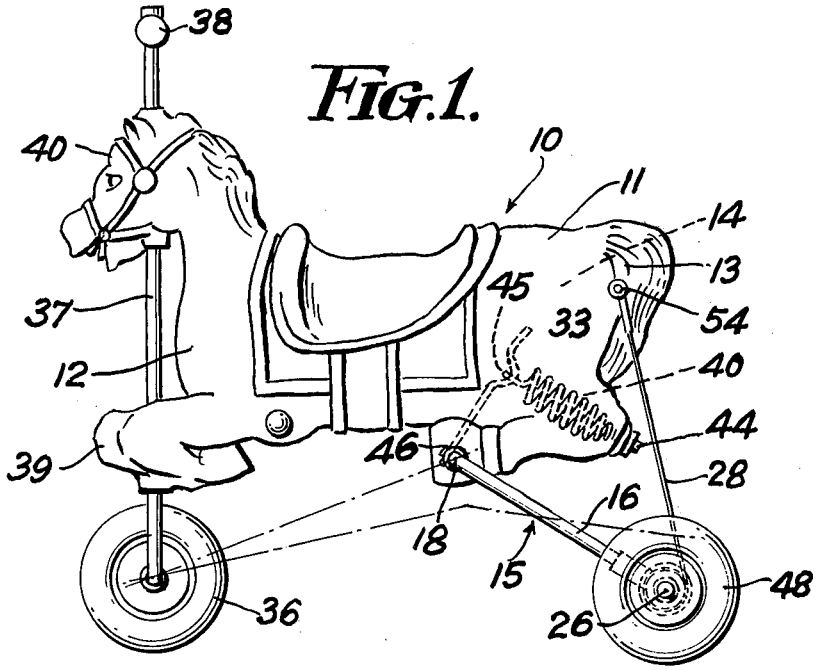
FIG. 1 is a side view of the toy according to the invention.
Figure 2:
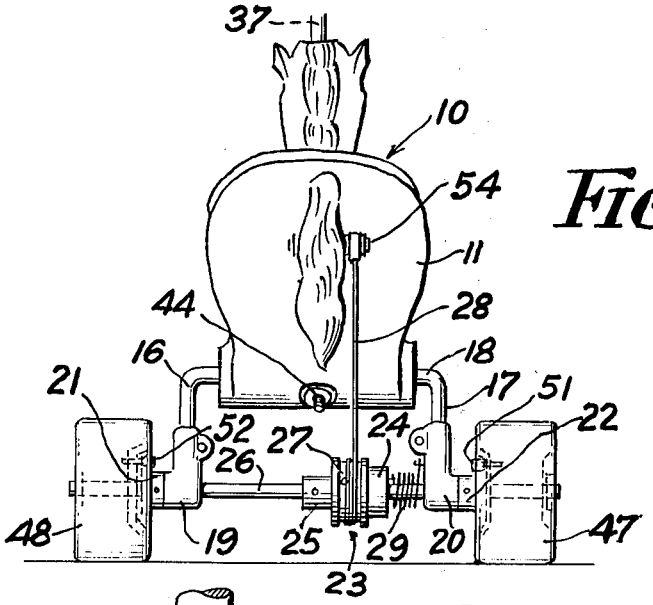
FIG. 2 is a rear view of the toy according to the invention.
Figure 3:
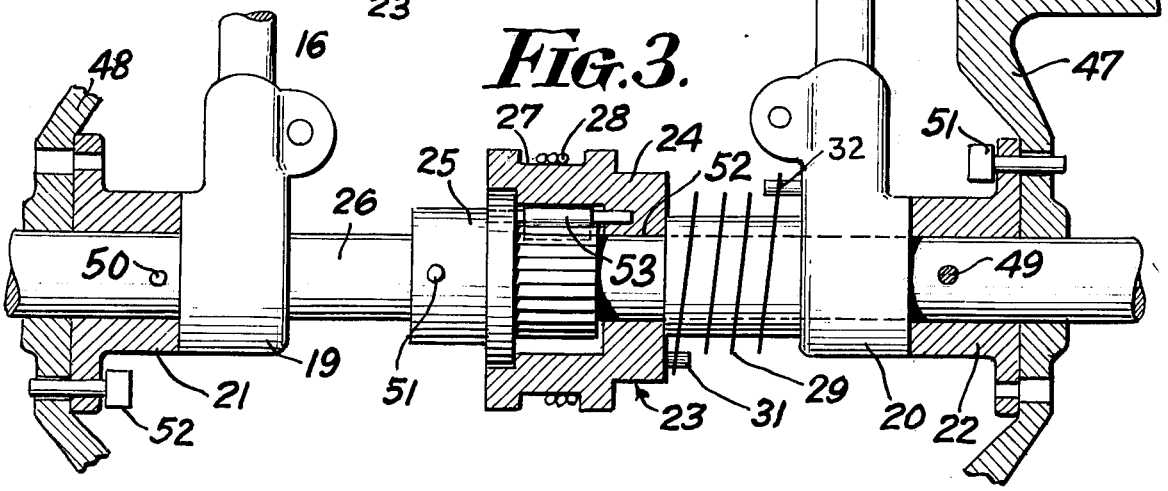
FIG. 3 is a longitudinal cross-sectional view of the rear drive system according to the invention.

Now, with more particular reference to the drawing, the toy 10 has a body 11 shown by way of example as a horse with a saddle, bridle, head, tail and front legs. Instead of a horse, the body could be made in the form of any other animal, bird, or vehicle such as a motorcycle or automobile. The body 11 has a front 12 and rear 13 and is supported by a rear suspension connected to the rear axle by a one-way clutch 23 in such a way that when a child sits on the toy and bounces up and down on the body 11, the rear wheels will be driven forward. The clutch's inner member 25 is fixed to the axle 26 and a cable 28 is wound around and attached to its outer member 24. The cable 28 is fixed to the body at 54.

Wheels 47 and 48 are rotatably supported on axle 26. Hubs 21 and 22 are received on axle 26 and held to rotate with axles 26 by fastening members 49 and 50. Removable pins 51 and 52 hold wheels to rotate with hubs 21 and 22. Pins 51 and 52 can be removed so that the toy will freely roll. Wheels 47 and 48 have rubber tires to insure better friction with the floor. When the body moves downward stretching the tension spring 40, tension on cable 28 is relaxed and torsional coil spring 29 rotates the outer clutch member 24, thereby winding the cable on the outside surface 27 of the clutch member 24. On upward movement of the body, the tension spring 40 inside the hollow 14 of the horse's body engages the body at end 44 and exerts its force on levers 33 at 45 and swings the U-shaped frame 15 downward, pulling the cable 28 upward and thereby rotating the outer clutch member 24.

The U-shaped frame 15 has legs 16 and 17 that terminate in bearings 19 and 20 which freely receive the axle 26. The intermediate part 18 of the frame is fixed to the lever 33 and is pivoted to the body at 46. The inner member 25 of the one-way clutch as well as hubs 21 and 22 are fixed to the axle 26 to rotate with it. The pin 51 is shown by way of example only and the inner clutch member could be attached to axle 26 by any suitable means familiar to those skilled in the art. The outside member 24 of the one-way clutch 23 may freely rotate on the inner member in one direction but is locked to the inner member 25 when rotated in the opposite direction. This locking action can be accomplished by any ratchet design familiar to those skilled in the art. In the example shown, applicant prefers to use a one-way clutch that is molded of thermoplastic material and has ratchet teeth and a pawl arrangement 53.

The coil spring 29 is fixed to the outer clutch member 24 at one end by a suitable connector 31 and to the bearing 20 at 32.

The lower end of steering rod 37 is bent at right angles to the vertically-extending part and the front wheel 36 is supported on the laterally-extending part of steering rod 37 extending up through the front legs 39 of the horse's body and up through the head 30 and has a handle bar 38 fixed to its upper end.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A toy comprising, a body, said body having a front end and a rear end, said rear end having a hollow therein, a U-shaped rear frame having two legs and a transverse member connecting said legs, said legs each having bearing means on the distal ends thereof, an axle extending transversely of said toy and rotatably received in said bearing means, two rear wheels, said rear wheels being supported on said axle on the ends thereof and pinned against rotation thereon, a one-way clutch, said one-way clutch having an outer member and an inner member, said inner member being fixed to said axle, and means to allow said outer member to rotate in one direction relative to said inner member but restrained against rotation relative to said inner member in the other direction, a drum surface on the outer periphery of said outer member, a cable wrapped around said drum surface and extending upwardly and fixed to said body, a return spring, said return spring having one end attached to a said bearing and the other end fixed to said outer clutch member, urging said outer clutch member to rotate in a direction to wrap said cable on said drum surface, a crank member in said hollow, one end of said crank member being fixed to said transverse member of said frame, the other end of said crank member extending upwardly, generally perpendicular to said legs, a tension spring, said tension spring being disposed in said hollow in said body and having one end fixed to said body and the other end connected to the distal end of said crank, whereby a load on said body causes said U-shaped frame to tend to rotate, exerting a tensile force on said spring and allowing said cable to wrap on said outer drum surface, said outer member of said one-way clutch, said tension spring urging said legs to move downwardly, lifting said body whereby said clutch and said inner member with it, rotate, said axle pinned thereto, whereby said wheels are rotated in a forward direction with each cycle of movement downward and upward of said body.

2. The toy recited in claim 1 wherein a rod member extends upwardly through the front end of said body and a wheel is supported on the lower end of said rod, and a handle is supported on the upper end of said rod for rotating said rod, thereby steering said vehicle.

3. A toy comprising, a body, a frame extending downwardly from said body and movable upwardly and downwardly relative thereto, an axle rotatably supported on said frame, wheels on said axle, a one-way clutch on said axle, said clutch having an inner member fixed to said axle and an outer member freely rotatable in a first direction and having means to restrain said inner member and said outer member to rotate together in a second direction, a flexible member having a first end and a second end, said first end being fixed to said body and said second end being wrapped around said outer member, and resilient torsional means connected to said outer member urging said outer member to rotate in said first direction, whereby, as said body moves up and down, said one-way clutch rotates said axle, moving said wheels on the floor.

4. The toy recited in claim 3 wherein said toy has at least one front ground engaging wheel thereon and means to steer said front wheel.

5. The toy recited in claim 3 wherein said resilient torsional means comprises a helical spring disposed around said axle and connected to said outer clutch member at one end and connected to said frame at the other end whereby said outer clutch member is urged to rotate in said first direction to wind said cable on said second clutch member.

6. The toy recited in claim 3 wherein said frame comprises a U-shaped member having an intermediate part, bearing means supporting said intermediate part of said U-shaped member on said body, said wheels being supported on the ends of the legs of said U-shaped member, a crank fixed to said intermediate part of said U-shaped member, and a tension spring connected to said crank, urging said legs of said U-shaped member to move downward, lifting said body.

7. The toy recited in claim 6 wherein said clutch is a one-way clutch and comprises a ratchet member having a pawl and teeth thereon, said pawl being connected to said outer clutch member and said teeth being connected to the said inner clutch member whereby said inner clutch member and said outer clutch member are restrained to rotate together in said second direction to advance said axle, and said outer clutch member and said inner clutch member rotate relative to each other in said first direction.

8. The toy recited in claim 1 wherein said body is in the form of an animal body having rear legs and said tension spring is disposed in said legs and has a washer on the outside of the animal body resting thereon and said spring has means extending therethrough retained on said washer.

9. The toy recited in claim 7 wherein said body has front knees and a head and said front wheel is supported on a rod extending through said knees and said head.

* * * * *